United States Patent [19]

Hickman et al.

[11] 4,323,290

[45] Apr. 6, 1982

[54] TELEPHONE ENCLOSURE ASSEMBLY AND DIRECTORY HOLDER APPARATUS

[75] Inventors: John S. Hickman; John B. Olson, both of Milwaukee; Richard L. Jeanson, Watertown, all of Wis.

[73] Assignee: Utility Products, a division of Reliable Electric Co., Milwaukee, Wis.

[21] Appl. No.: 108,822

[22] Filed: Dec. 31, 1979

[51] Int. Cl.[3] ..... A47B 63/00; B42D 17/00; E04H 1/14

[52] U.S. Cl. ..... 312/100; 312/233; 312/245; 248/447; 52/27; 52/36

[58] Field of Search ..... 312/100, 233, 245, 248; 52/27, 36; 248/447

[56] References Cited

U.S. PATENT DOCUMENTS

| | | | |
|---|---|---|---|
| 366,680 | 7/1887 | Noyes | 248/447 |
| 527,204 | 10/1894 | Jaeger | 248/447 |
| 2,104,425 | 1/1938 | Kuntz | 52/36 |
| 2,612,427 | 9/1952 | Faulkner et al. | 312/233 |
| 2,736,928 | 3/1956 | Manning | 52/36 |
| 2,978,831 | 4/1961 | Nawman et al. | 248/447 |
| 2,982,593 | 5/1961 | Chambers | 312/100 |
| 3,164,868 | 1/1965 | Hannula et al. | 52/36 |
| 3,228,648 | 1/1966 | Tils | 312/233 |
| 3,247,332 | 4/1966 | McHugh | 312/245 |
| 3,275,279 | 9/1966 | Caldwell et al. | 248/447 |
| 3,300,917 | 1/1967 | Bartley et al. | 312/245 |
| 3,317,176 | 5/1967 | Herrin | 312/233 |
| 3,338,002 | 8/1967 | Ericsson et al. | 52/36 |
| 3,571,988 | 3/1971 | Nawman | 52/27 |
| 3,750,350 | 8/1973 | Anon | 52/27 |
| 3,860,212 | 1/1975 | Nawman | 248/447 |
| 4,103,980 | 8/1978 | Silva | 312/245 |

*Primary Examiner*—Victor N. Sakran

*Attorney, Agent, or Firm*—Merriam, Marshall & Bicknell

[57] ABSTRACT

A telephone enclosure assembly and directory holder device for use with indoor/outdoor telephone installations. The enclosure includes a one-piece cast or molded plastic housing shell. Side panels can be fastened to the shell and a security lock clip permits the panels to be locked in place but readily replaced in the event of sidewall damage or vandalism. A directory holder is attached to the shell and is capable of storing several directories which can be rotated from a closed position to an open position, allowing each reader to comfortably view all printed matter on each and every page of the directory.

4 Claims, 21 Drawing Figures

29
31
38
34
39
36
32
33
26
7
14
13
40
41
47
20
22
13
28
25
27
21
46
12
53
50
51
52
51
44
43

TELEPHONE ENCLOSURE ASSEMBLY AND DIRECTORY HOLDER APPARATUS

This invention relates to a new and improved enclosure assembly and easy access directory holder employed for use with wall or pedestal mounted telephone unit and, more particularly, the invention disclosed and claimed herein relates to a relatively lightweight, one-piece molded or cast enclosure for use with indoor/outdoor telephone units and a new and unobvious directory holder which is readily moved from a closed to an open position where a directory and each page in said directory is readily accessible to an individual.

BACKGROUND OF THE INVENTION

Over the years, different booths and enclosures have been provided for indoor and outdoor telephone units such as exemplified in U.S. Pat. Nos. 3,571,988, 3,338,002, 3,275,279, 3,247,332, 3,164,868, 3,300,917, 2,982,593 and 2,104,425. The enclosures are generally of two types, the first being a walk-in booth in which a door is opened to permit a person to enter and exit from a booth which contains a mounted telephone unit assembly. An enclosure of this first type is illustrated in U.S. Pat. No. 2,104,425.

A second type of telephone enclosure is one which is adapted to partially enclose a mounted telephone unit. Enclosure units of the second type are illustrated in the various patents identified in the above paragraph. The invention disclosed and claimed herein primarily relates to the second type of enclosure for partially enclosing a mounted telephone unit; however, it is appreciated that various features of the invention disclosed and claimed herein could be incorporated in walk-in type enclosure booths.

It has been found that enclosure assemblies presently available for use with telephone units suffer from certain disadvantages.

Some enclosures are too bulky and heavy and require more than one person to install or repair the enclosure. Other enclosures involve an excessive number of component parts such that the installation of the unit is quite time-consuming and increases the overall cost of the enclosure. Still further, other units suffer from the disadvantage that vandals can too easily destroy or otherwise remove the telephone assembly enclosure because the fastening means for connecting various enclosure components are not tamper-proof and are too visible or accessible to a vandal.

It is desired to eliminate the problems associated with telephone enclosures presently available by utilization of a telephone enclosure which preferably is relatively lightweight and comprise only a few component parts whereupon, in installation, only one installer is required to assemble the enclosure. Additionally, it is desired that in the event repair of a unit is required the necessary repairs can be completed quickly and preferably by only one repair person.

Additionally, it is desired that the enclosure assembly include an easy access directory holder for a telephone directory whereby the holder, in substantially all instances, can be moved from a closed to an open access position with all information on any chosen directory page being displayed in an unobstructed manner.

SUMMARY OF THE INVENTION

The telephone enclosure assembly of the present invention serves to obviate the problems and disadvantages of the prior art. Briefly, the enclosure assembly of the present invention comprises a one-piece relatively lightweight housing shell which serves to partially enclose a mounted telephone unit. The housing shell can be installed by one person and can readily be locked in a mounted position by means of a security wedge locking device which is discretely positioned on the enclosure and serves to lock the enclosure and phone unit in position relative to a wall or pedestal.

In the event the enclosure assembly is damaged or vandalized, it can be replaced or repaired quickly by one repair person.

Further, the assembly includes a directory holder device which is conveniently attached to the enclosure for easy access by a person desiring directory information. The holder can store more than one directory and can be moved or rotated from a closed, convered position to an open position whereby the holder is located only a few inches away from the telephone dial thereby permitting the directory information to be easily accessible to an individual. The directory holder mechanism permits access to and a full view of each page in a directory.

The enclosure also includes protective see-thru side panels which, in the event of damage, can be removed and replaced by means of a reuseable panel locking clip means which is set in the molded housing so that it is not readily accessible or easily visible.

A further understanding of the invention as well as additional objects and advantages will appear from the following detailed description.

DETAILED DESCRIPTION OF THE INVENTION

FIG. 1 of the drawings show a perspective view of the telephone enclosure and directory holder assembly of the present invention with the holder shown in a closed position;

DETAILED DESCRIPTION

The Housing Shell Assembly

Figure 1:
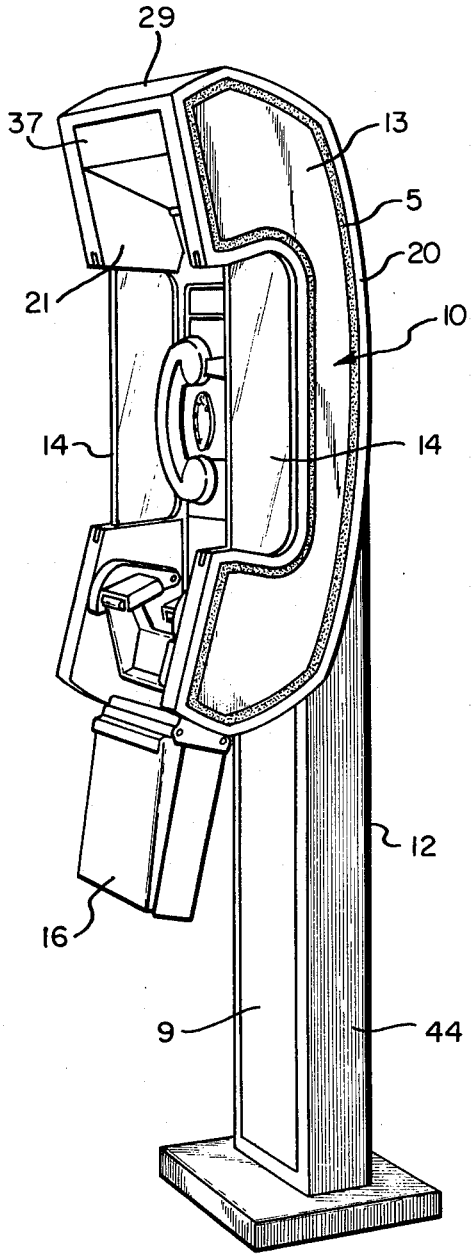
Figure 2:
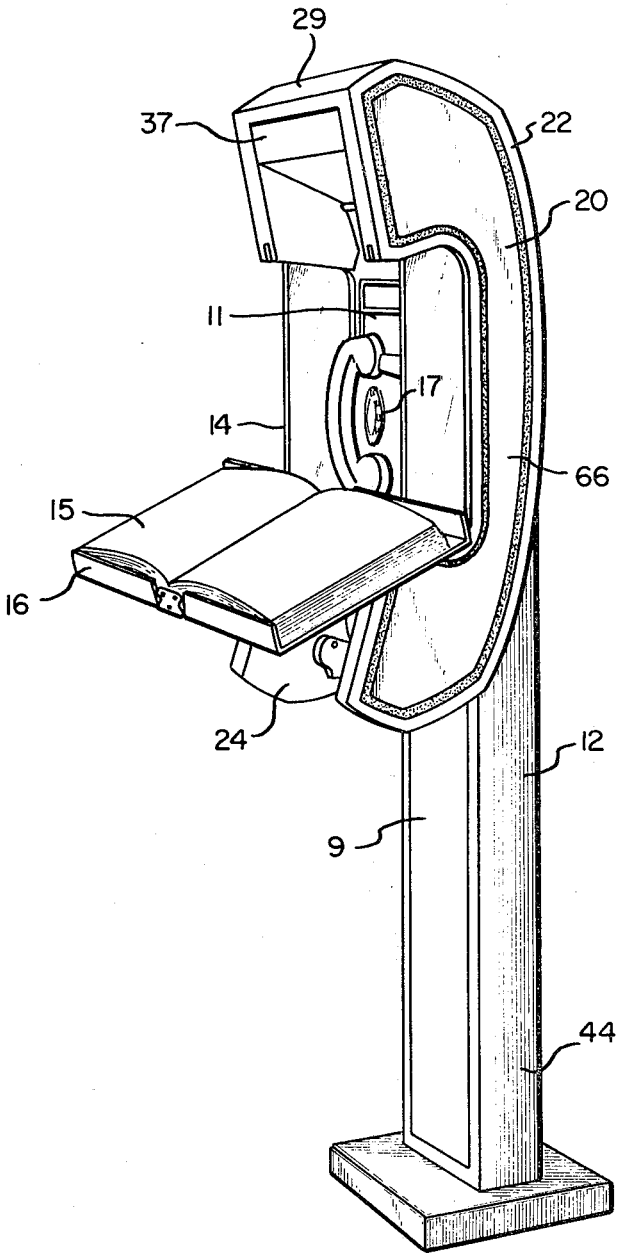
FIG. 2 shows a perspective view of the assembly of FIG. 1 with the directory holder in an open position.

Referring to FIGS. 1 and 2, telephone enclosure and directory holder assembly 10 are shown assembled to a conventional pay type telephone unit 11 which in turn is connected to a mounting pedestal 12.

Assembly 10 comprises a one-piece unitary enclosure housing shell 13, and a pair of side panels 14. Directories 15 are disposed in a directory holder 16 which is in a closed position in FIG. 1 and an elevated, open position in FIG. 2 whereby the directories are located conveniently next to the telephone dialing member with only a few inches separating the directory 15 from the phone dialing member 17 which can be a dial wheel or a push-button arrangement.

Housing shell 13 is an integral member preferably molded of a plastic material to provide a relatively light-weight, substantially rigid and durable member. One plastic material that has been found satisfactory for molding the shell is a cross-linked polyethylene manufactured by Phillips Petroleum located in Bartelsville, Okla. The material is sold under the trademark Marlex-CL-100 and is further identified in Technical Service Memorandum TSM-244 dated November 1977.

The shell can be molded to provide a particular configuration and, as shown in the drawings, as for example FIGS. 1 and 2, the shell has been molded to provide a telephone profile for the purpose of further assisting to identify the assembly to a prospective telephone user.

Figure 10:
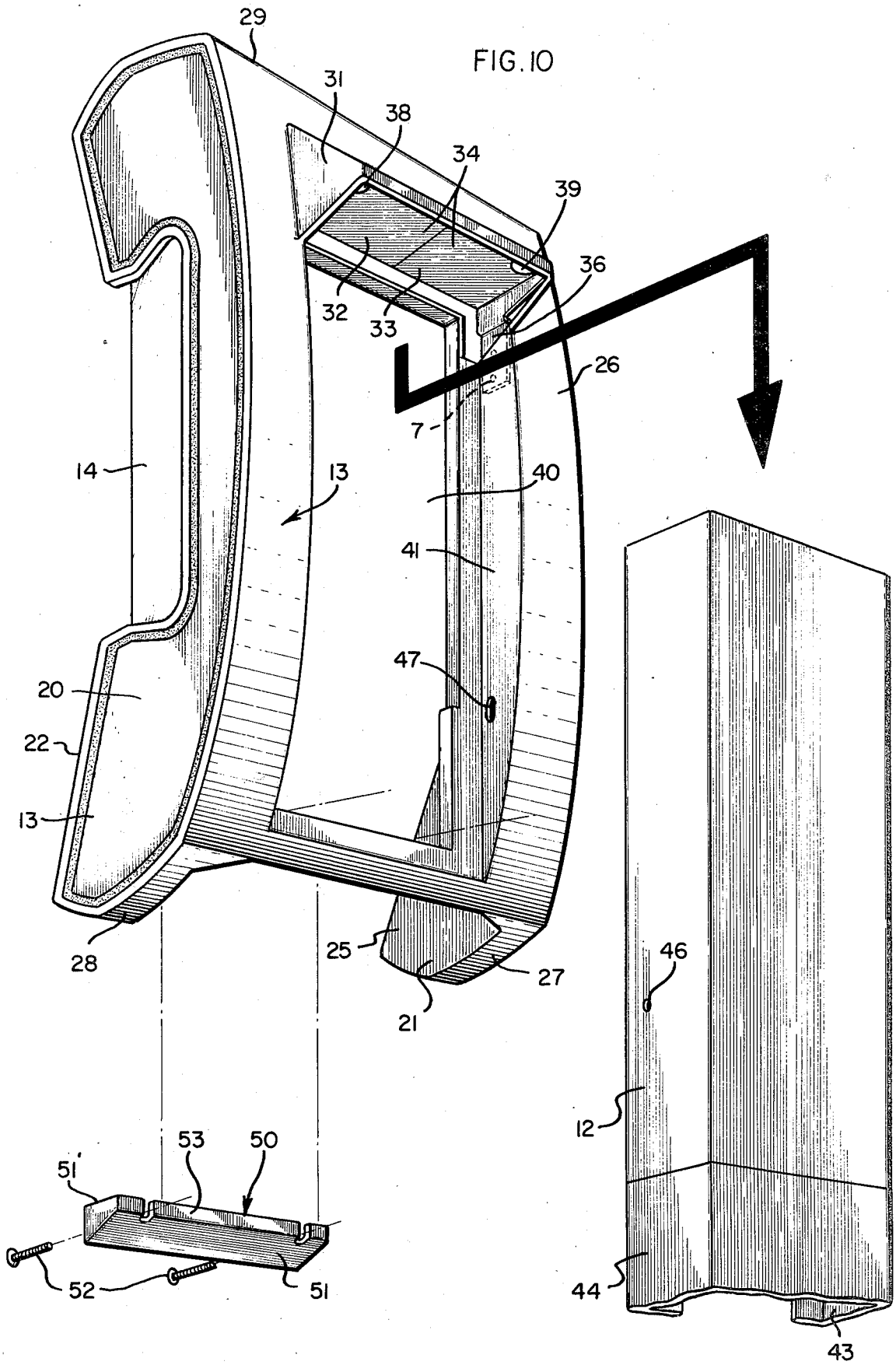
FIG. 10 shows a partial, perspective view of the enclosure housing in a disassembled, unlocked position relative to a mounting pedestal.

Enclosure shell 13, FIGS. 10–15 comprises a hollow molded member which includes side walls 20, 21 each having inner and outer faces 22, 23 and 24, 25 respectively. (FIG. 15) Back wall 26, bottom walls 27, 28, top wall 29 and front wall 30 serve to form the housing shell. A molded integral mounting cantilever cap 31 projects outwardly from the back wall 26 of shell 13. A pair of optional security plates 32, 33 are disposed within cap 31. Each plate includes a flanged plate member 34 having a mounting arm 36, only one of which is shown in FIG. 10, which extends down the inside surface of shell section 41. Each mounting plate arm 36 is fastened by suitable fastening means, e.g., stainless steel poprivets 7, to the appropriate inner side wall face 41 of shell 13.

If desired a conventional light source can be disposed within shell 13, the light fixture preferably being fastened to the inside face of top wall 29. A conventional acrylic lens 37 can be fastened to the housing shell to cover the light source. Plate members 34 have conventional round openings 38, 39 for the passage of conduit from the housing shell through the pedestal to either the telephone circuit or a power source, respectively.

Referring to FIG. 10, it will be observed that the back wall of housing shell 13 is provided with an opening 40, the edges of the opening being complimentary to the shape of the telephone unit 50 which is adapted to seat in opening 40 when shell 13 is mounted on pedestal 12. Upon assembly, shell cantilever cap 31 is seated on the top of pedestal 12 so that recessed shell side sections 41, 42 (FIG. 15), are positioned adjacent respective pedestal side walls 43, 44. After shell 13 is seated on pedestal 12, as seen more clearly in FIGS. 10, 14 and 15, security bolts 45 can be threaded through tapped holes 42 in pedestal side walls 43 and 44, extending thru and well beyond slots 47 located in shell side sections 41, 42 to make shell 13 theft difficult.

Following assembly of housing shell 13 to pedestal 12, a conventional pay phone unit 11 can be suitably attached to the pedestal. Upon assembly phone unit 11 extends outward from pedestal 12, through shell opening 40 and beyond the inclined shell wall 48, FIG. 14, located at the bottom of opening 40. It is appreciated that while the phone assembly has been described in association with pedestal 12, enclosure shell 13 and directory holder 16 can, if desired, be mounted to a building wall or the like by attaching a metal housing to the wall and, in turn, fastening shell 13 by these described means.

Figure 14:
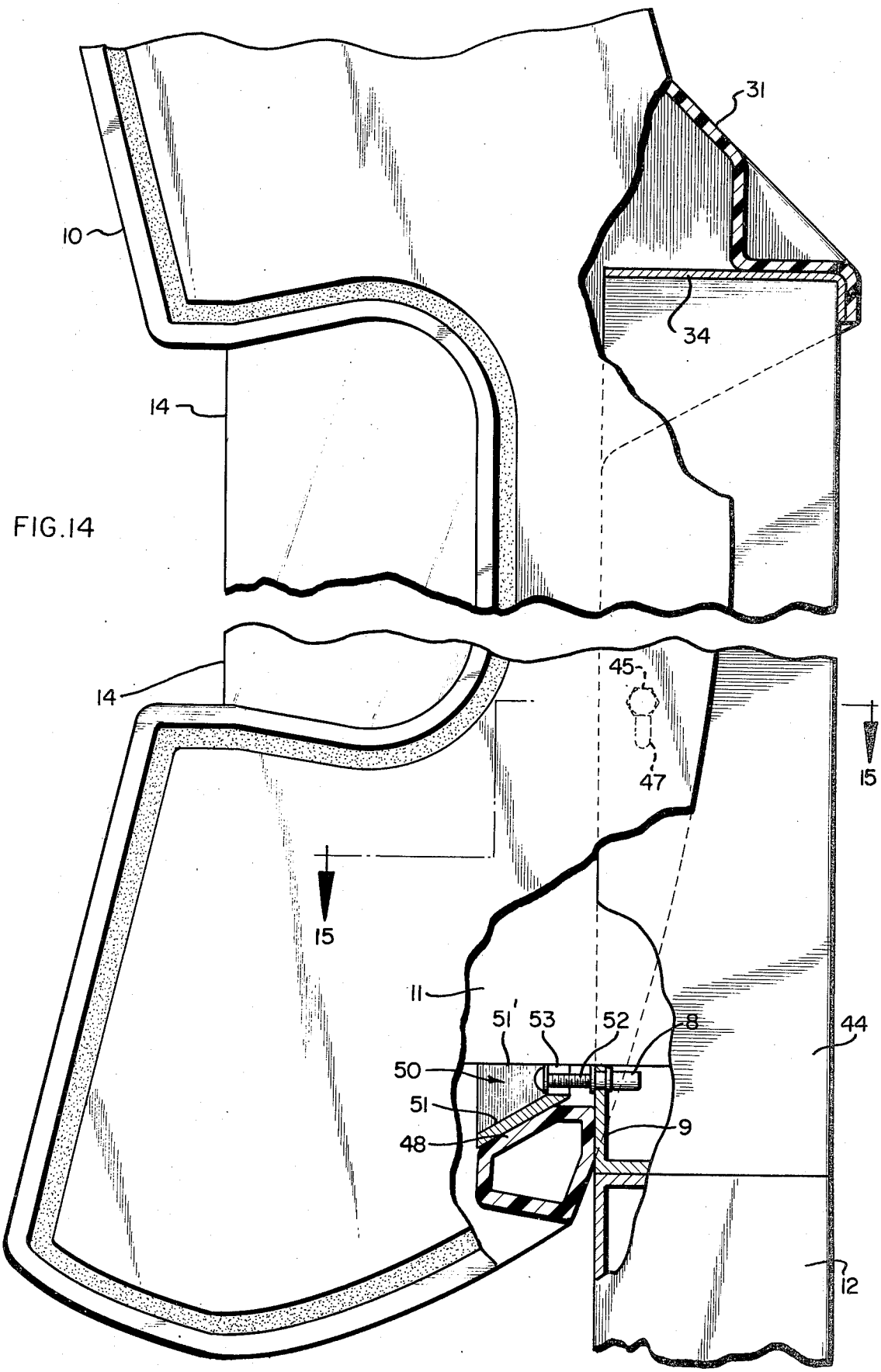
FIG. 14 shows a fragmentary side view of the telephone enclosure assembly of the present invention with the housing shell mounting cap seated on the top of a pedestal and the housing shell locked in position by a security wedge means.
Figure 15:
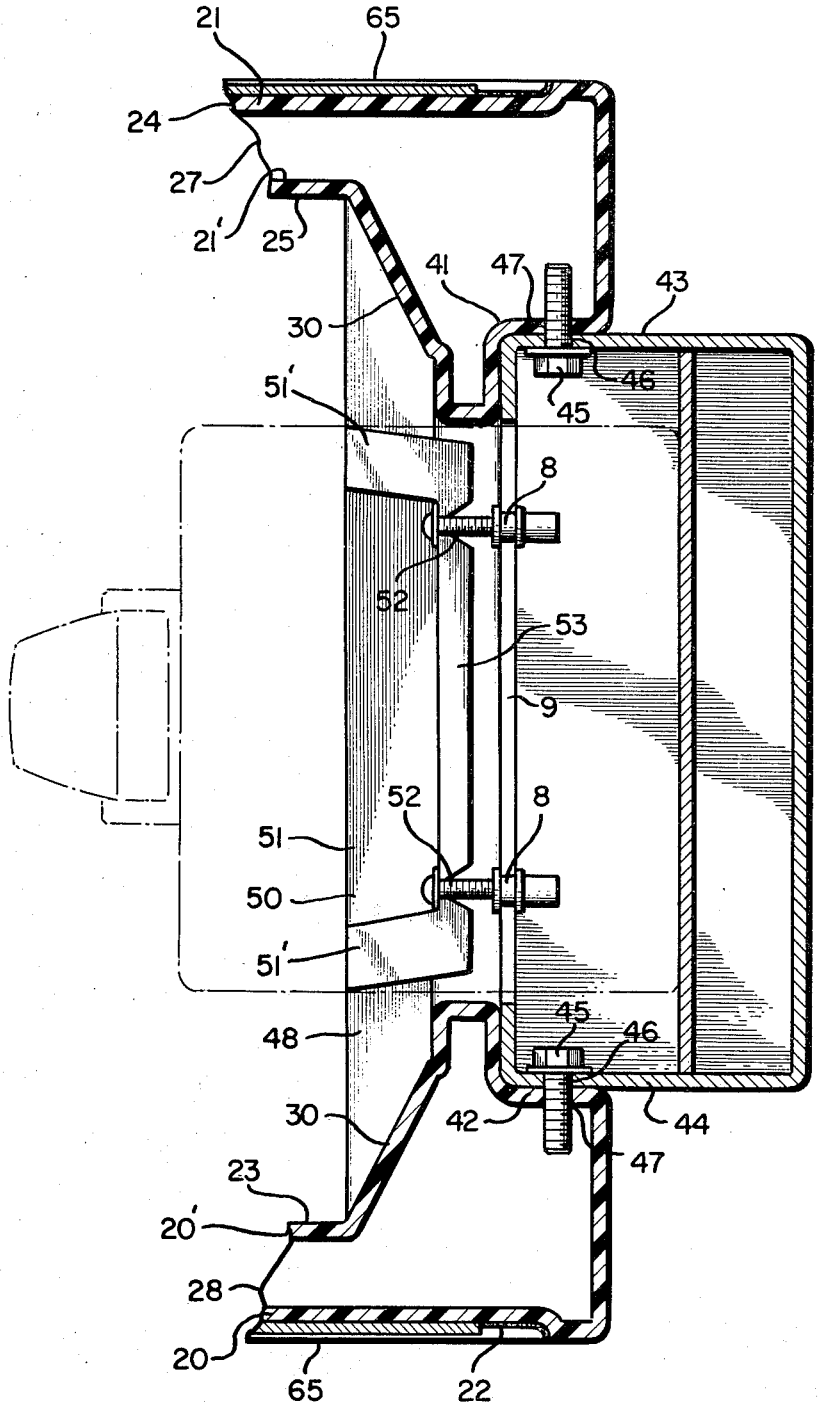
FIG. 15 shows a plan section view taken along lines 15—15 in FIG. 14 of the security wedge means and pedestal locking means.

An additional security locking device can be utilized to lock shell housing 13 to pedestal 12. Referring to FIGS. 10, 14 and 15, a security wedge member 50 comprises a pair of said walls 51', inner wall 53 and an inclined wall 51, which is complimentary with inclined wall 48. Wedge member 50 is adapted to be inserted between the bottom wall of phone unit 11 and inclined wall 48 as seen more clearly in FIGS. 14 and 15. Pin-headed security screws 52 are passed through openings in wall 53 of wedge member 50. Screws 52 are threaded into tapped fasteners 8 located in wall 9 of pedestal 12. Upon threading of screws 52 into fasteners 8, member 50 is wedged between phone unit 11 and shell wall 48 thereby serving to lock and secure housing shell 13 to pedestal 12. This wedging action accommodates for shells having manufacturing tolerance variations in both opening 40 and/or the distance between the upper bearing surface on plate member 34 (FIG. 10) and the lower bearing surface on inclined wall 48 (FIG. 14). When installed, the wedge member is not readily visible because it is positioned below telephone unit 11. Further there is no outer wall which an individual could pull to tamper with the security wedge because member 50 includes only inclined wall 51 and side walls 51'. It will also be observed from FIG. 14 that bolts 52 are positioned against 53 and therefore are not readily visible and a snug, rattle-free attachment is provided between the housing 13 and pedestal 12.

The Enclosure Side Panel Assembly

Figure 3:
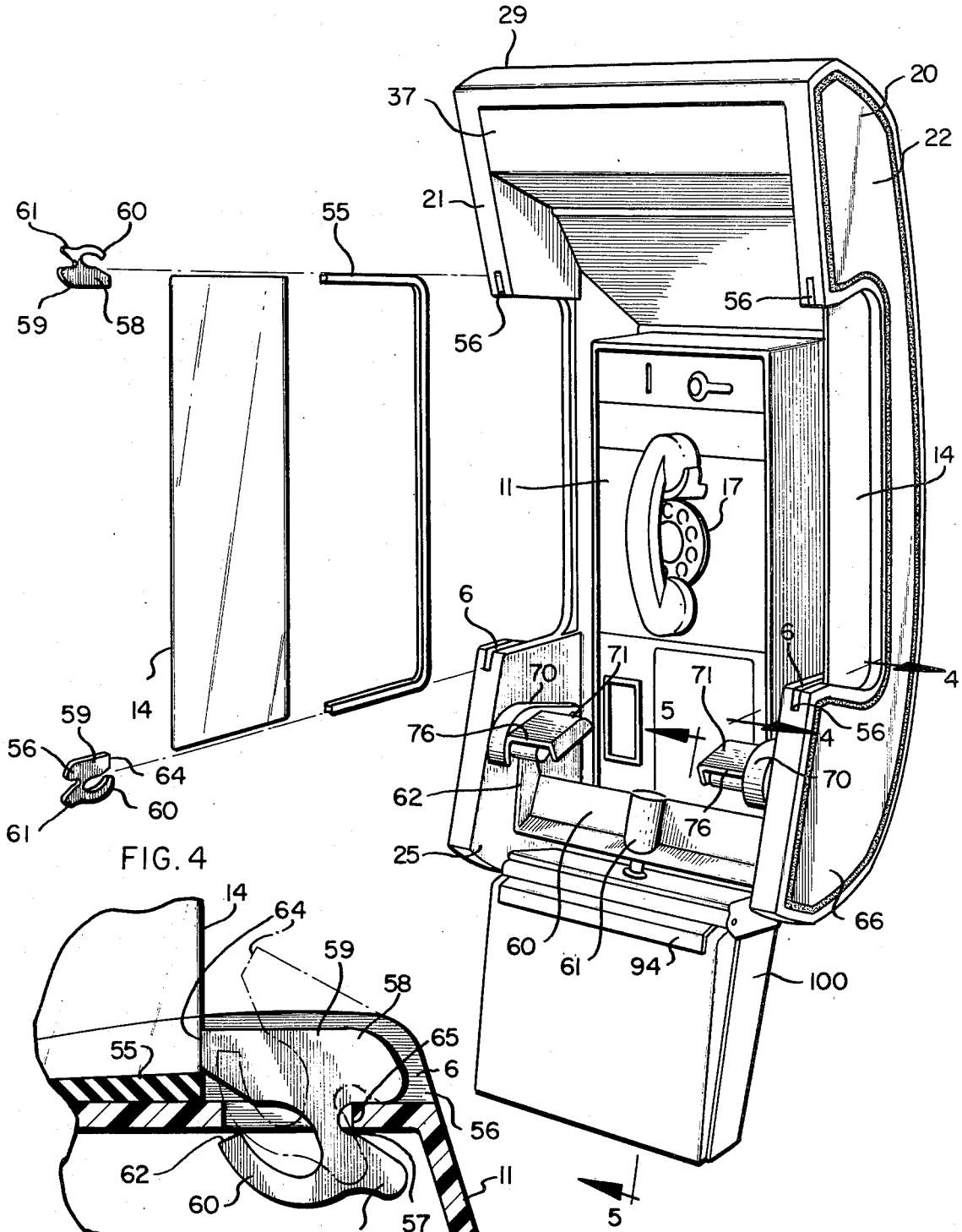
FIG. 3 shows a perspective view of the telephone enclosure and directory holder assembly of the present invention with one of the two side, panels illustrated in an unassembled condition.

Turning to FIGS. 1 to 3 inclusive, a side panel 14 is located on each side of shell housing 13. Side panels 14 preferably are clear, transparent plastic or glass members which serve to add decor, provide nighttime backlighted signs and protect the phone unit from the elements while at the same time permitting the passage of light through the panels during daylight hours. If desired, the side panels could be fabricated of an acoustic material.

As shown in FIG. 3, each panel assembly 14 includes an insulating strip 55 which is adapted to be disposed about the top, bottom and back panel edges. It has been found, however, that if desired, the insulating strip can be wholly or partially deleted in various applications.

Each panel 14 and insulating strip 55 is inserted in a recess 56 located in the sidewall of shell 13 so that the top, bottom and back panel edges are positioned within the recess.

Figure 4:
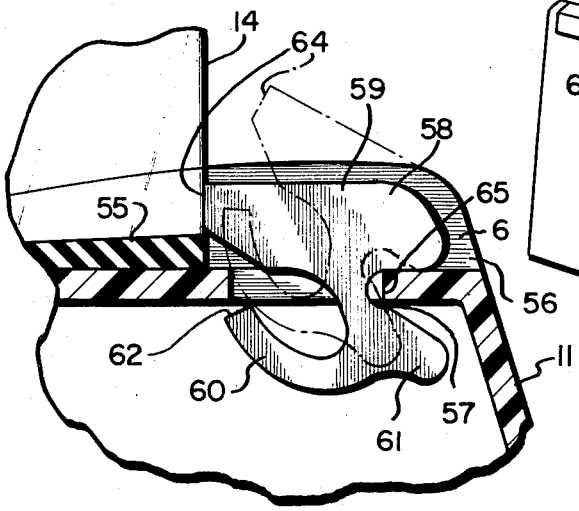
FIG. 4 shows a section view taken along lines 4—4 in FIG. 3 with the side panel security clip being illustrated in the locked and unlocked positions.

FIG. 4 shows an opening 57 located in shell 13 at the location of the recess. While only one opening 57 is shown in FIGS. 4 and 10, two openings are provided in each recess 56 contiguous to the location of the top and bottom of the front edge of side panel 14. Accordingly, when a panel 14 is inserted in recess 56, the panel is of a width which permits its front edge to rest adjacent or contiguous to the edge of top and bottom openings 57. A locking clip 58 is inserted thru opening 57, causing it to snap-lock and seat against the panel so that panel 14 remains in a fixed position in housing shell 13.

Locking clip 58 comprises a panel seating section 59 having a reverse C-shape finger 60 extending from the bottom of section 59. Finger 60 is biased so that it can be compressed toward section 59. A retaining lug 61 projects outwardly from finger 60 in a direction substantially opposite the free end 62 of biased finger 60. Clip 58 can be made of any suitable material which will provide the desired biasing characteristics. It has been found the clips can be molded or stamped from a plastic such as polyethylene or polypropylene of substantially the same thickness as panel 14.

After panel 14 has been inserted in recess 56 past the openings 57, the biased clip finger 60 is inserted in opening 57 in the manner shown in dotted lines in FIG. 4. As finger 60 is forced downward, it is compressed until the finger snaps through opening 57 at which time the edge 64 of section 59 seats against the front edge of panel 14 and edge 62 of finger 60 catches under the shell 13 wall. When shell portion 65 is seated in the groove formed between the bottom of section 59 and the top of retaining lug 61 the panel is locked in place. Once the panel is installed, it cannot be removed and the locking clip, as seen in FIG. 4, is positioned so that it does not extend out from the recess 56 and, therefore, is not readily visible.

In the event side panel 14 is damaged or destroyed, the remainder of the panel can be removed after which clip 58 is then moved in the direction toward the back wall of shell 13 until retaining lug 61 clears the shell portion 65. The clip can be pulled upward and removed upwardly and rearwardly from opening 57. When a new panel 14 is inserted, the clip 58 can be reused and reinserted in opening 57, as previously described, to lock a new panel in position. In the event an undamaged panel is to be replaced for any reason, the clip 58 can be severed by a repairman by inserting a sharp instrument, such as a knife-edge screwdriver, into the panel recess 6, FIGS. 3, 4, and severing finger 60 from section 59.

Color Recognition Panel

Figure 11:
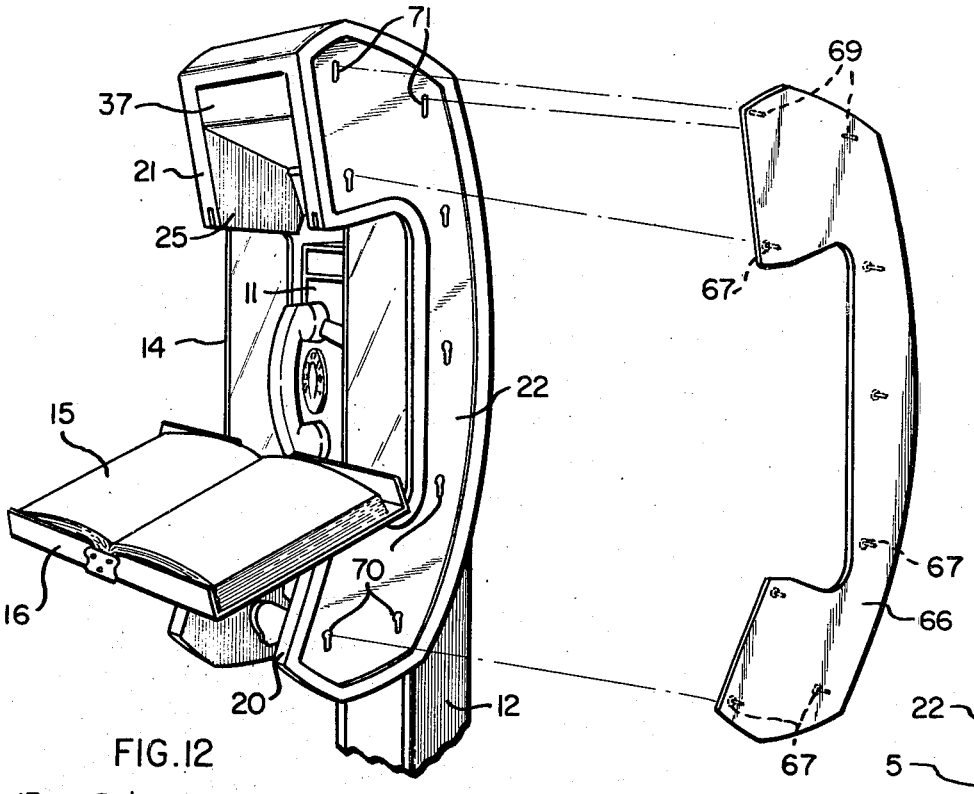
FIG. 11 shows a partial, perspective view of the telephone enclosure and a housing shell side cover panel removed from the housing shell.
Figure 12:
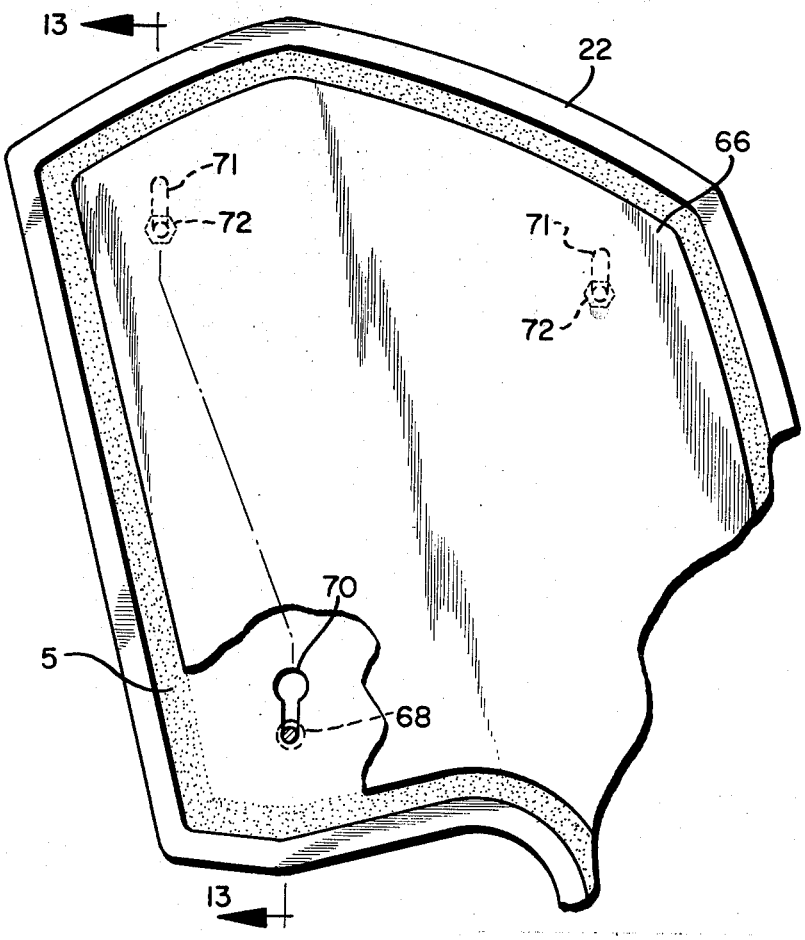
FIG. 12 shows a fragmentary, side view of the housing shell and housing shell side cover panel attached to a side wall of the housing shell.
Figure 13:
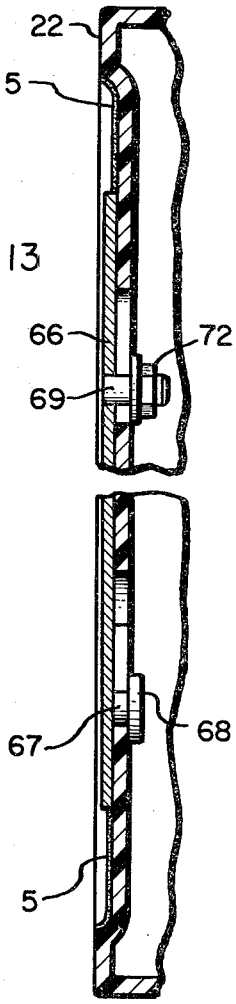
FIG. 13 shows an end section taken along lines 13—13 in FIG. 12 of the housing shell side cover panel mounted to the housing shell.

In order to provide an additional enclosure recognition indicator for a prospective telephone user, a color coded housing shell side wall panel 66 is located on the outer faces 22 and 24 of shell side walls 20 and 21. Panel 66, as seen in FIGS. 11–13, can either be a plastic or metal part having a telephone shape profile. A plurality of spaced studs 67 each having a button 68 located at the outer end of the stud, are positioned at desired locations on the panel. If desired, a nut can be threaded onto a stud in place of fixed button 68 so that an adjustable button in the form of a nut is provided. Near the top of panel 66, two spaced, threaded studs 69 are fastened to the panel. It will be observed that keyhole slots 70 are provided to receive the buttonheaded studs 67 whereas an elongated slot 71 is adapted to receive threaded stud 69.

In installation, panel 66 is aligned with a shell face 22 or 24 so that the buttons 68 can be inserted in the round section of the keyhole slot 70 while stud 69 is inserted into slot 71. The panel is then permitted to drop downward until the studs 67 and 69 seat against the bottom of slots 70 and 71. Prior to installation of light lens 37, a nut 72 is then inserted through the lens opening provided in the front shell wall and threaded onto each of the studs 69 whereby the panel 66 will be locked to housing shell 13. After nuts 72 have been threaded onto stud 69 and tightened down, the lens 37 can be mounted to the shell. Panels 66 can be easily replaced merely by removing the lens 37, then nuts 72 from studs 69 and lifting the panel upward, then outward so that the studs 67, 69 are removed from slots 70, 71.

It will also be observed that the housing side walls 20 and 21 can have their edges coated with a layer of reflective coating. Accordingly, when panel 66 is installed on the side walls 20, 21, a border 5 of reflective coating is provided so that at night, when a light, such as a car headlight beam, strikes the coating, a telephone profile is displayed.

The Directory Holder Mounting Assembly

Directory holder 16, containing one or more directories 15, is mounted to housing shell 13 at the bottom of the inner side wall faces 23, 25 as seen in FIGS. 3, 5–9. Mounting yoke 60 includes an enlarged swivel mounting receptacle 61 from which directory holder 16 depends. A yoke arm 62, only one of which is shown, extends outward from each end of yoke 60. Each yoke arm includes a pair of pivot posts 63, 64.

Lower arm members 65, only one of which is shown, each have one end 66 pivotally fastened at 67 to a shell housing inner sidewall face. The remaining end 68 of lower arm member 65 is pivotally connected at 69 to yoke 60 at yoke pivot post 63.

Upper arm members 70 each have a cap stop 71, FIG. 3, extending laterally from member 70. Ends 72 of members 70 are pivotally connected at 73 to the housing shell inner sidewall faces 23, 25. The remaining upper arm member ends 75 are each pivotally connected to yoke pivot post 64.

Figure 5:
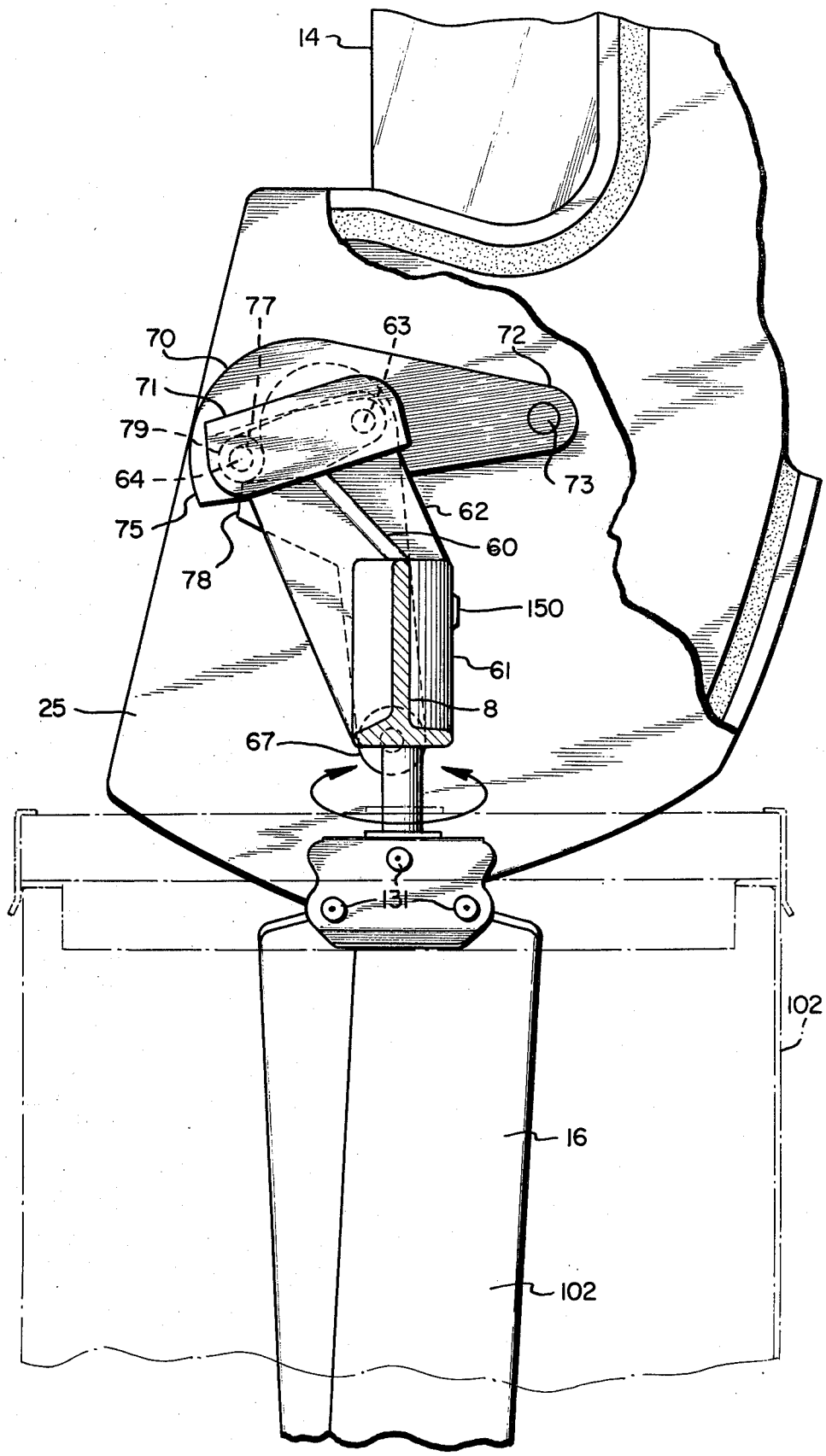
FIG. 5 shows a section view of the directory holder in a closed, covered position taken along lines 5—5 in FIG. 3.
Figure 9:
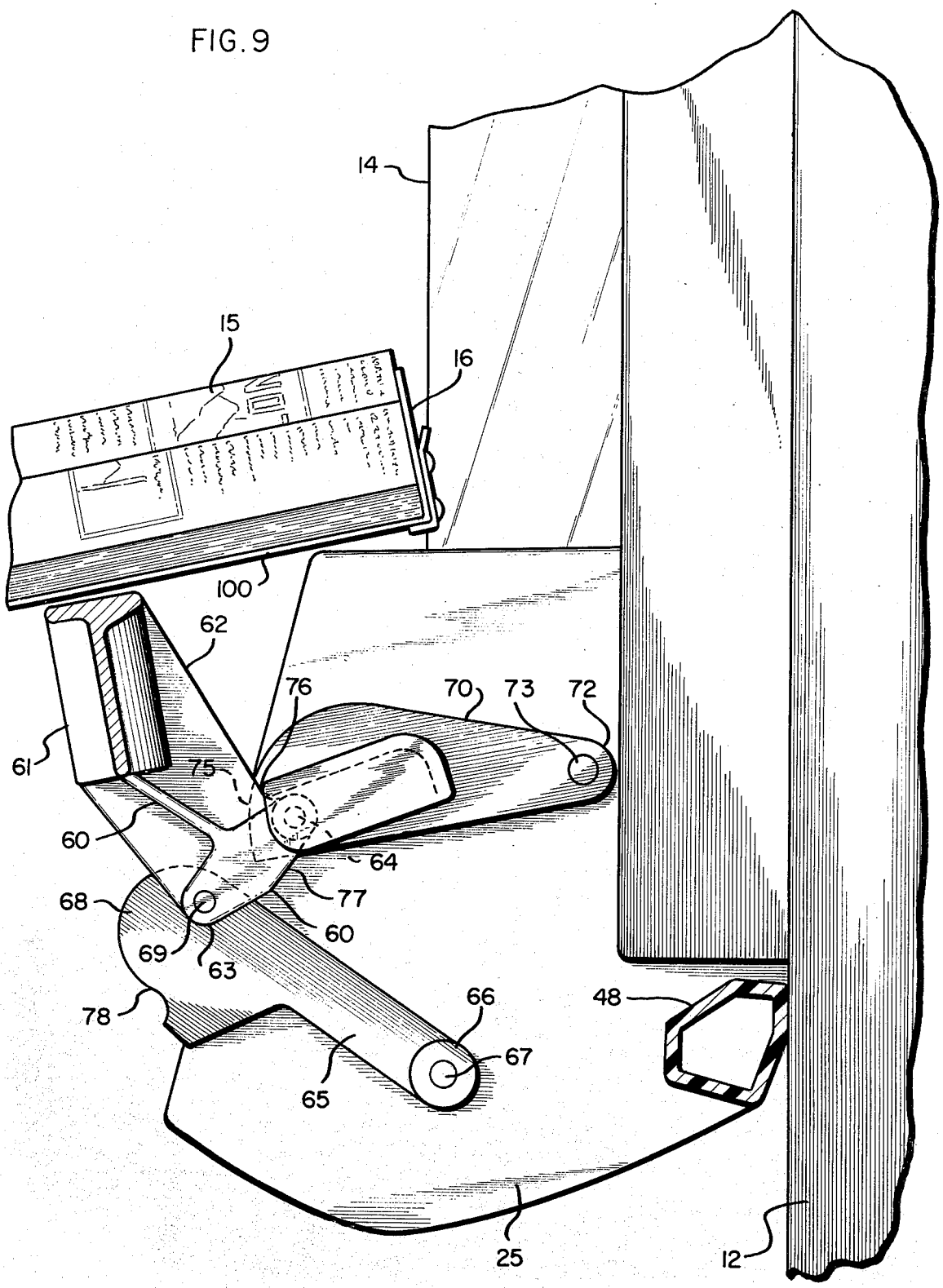
FIG. 9 shows a fragmentary section view of the directory holder of the present invention raised to an open position with the holder being open to expose various pages of a directory.

When directory holder 16 is moved from the closed position of FIG. 5 to the upward, open position of FIG. 9, yoke 60 and yoke arms 62 pivot about upper arm members 70 at pivot post 64. At the same time end 68 of lower arm member 65 pivots about yoke 60 and yoke arms 62 at pivot post 63 while end 66 pivots about the shell at 67. Mounting yoke 60 is adapted to pivot in an upward direction until yoke arms 62 abut the cap stops 71 at 76. Once the holder 16 is in its upward position, it is almost overcenter and very little effort is required to hold it in that position and directory 15 can be opened to a selected page as illustrated in FIG. 9.

After the desired information has been secured from the directory 15, holder 16 can be closed and returned to its normal closed position. Merely releasing the holder allows it to fall and as holder 16 moves downward, arm members 65 and 70 initially pivot upward about pivot connections 67 and 73. Yoke arms 62 pivot about pivot posts 64 and 69 until yoke wall 77 abuts the bottom of the cap stop 71 on upper arm member 70 (FIG. 5) and the wall 78 on lower arm member 62 abuts the cushioning urethane bearing washers 79 on pivot post 64. Accordingly, in the downward movement of holder 16, upper arm member 70 initially pivots in a clockwise direction about pivot post 73. When lower arm 64, which is pivoting in a clockwise direction about pivot post 67, has about passed under pivot post 64 due to the downward movement of yoke 60 and the counter-clockwise rotation of the yoke arms 62 about pivot post 64, upper arm member 70 will descend downward and pivot in a counter-clockwise direction until it impacts and abuts urethane cushioned pivot post 64 precluding further movement of holder 16. Holder 16 will then remain in this downward position until it is necessary to again utilize the directory.

The Directory Holder

Directory holder 16 includes an extruded metal or molded plastic backbone member 80 (FIGS. 16–21) having a base 81 and a flanged hinge post 82 extending from and along the length of each side of base 81. Each post 82 includes a hinge stop 83 and a tubular shaped section 84 slotted along its length at 85. Each end of section 84 is tapped at 86. As seen more clearly in FIG. 19, a recess 87 is provided in hinge post 82, hinge stop 83 and tubular section 84 at a location contiguous to each end of backbone member 80.

Figure 16:
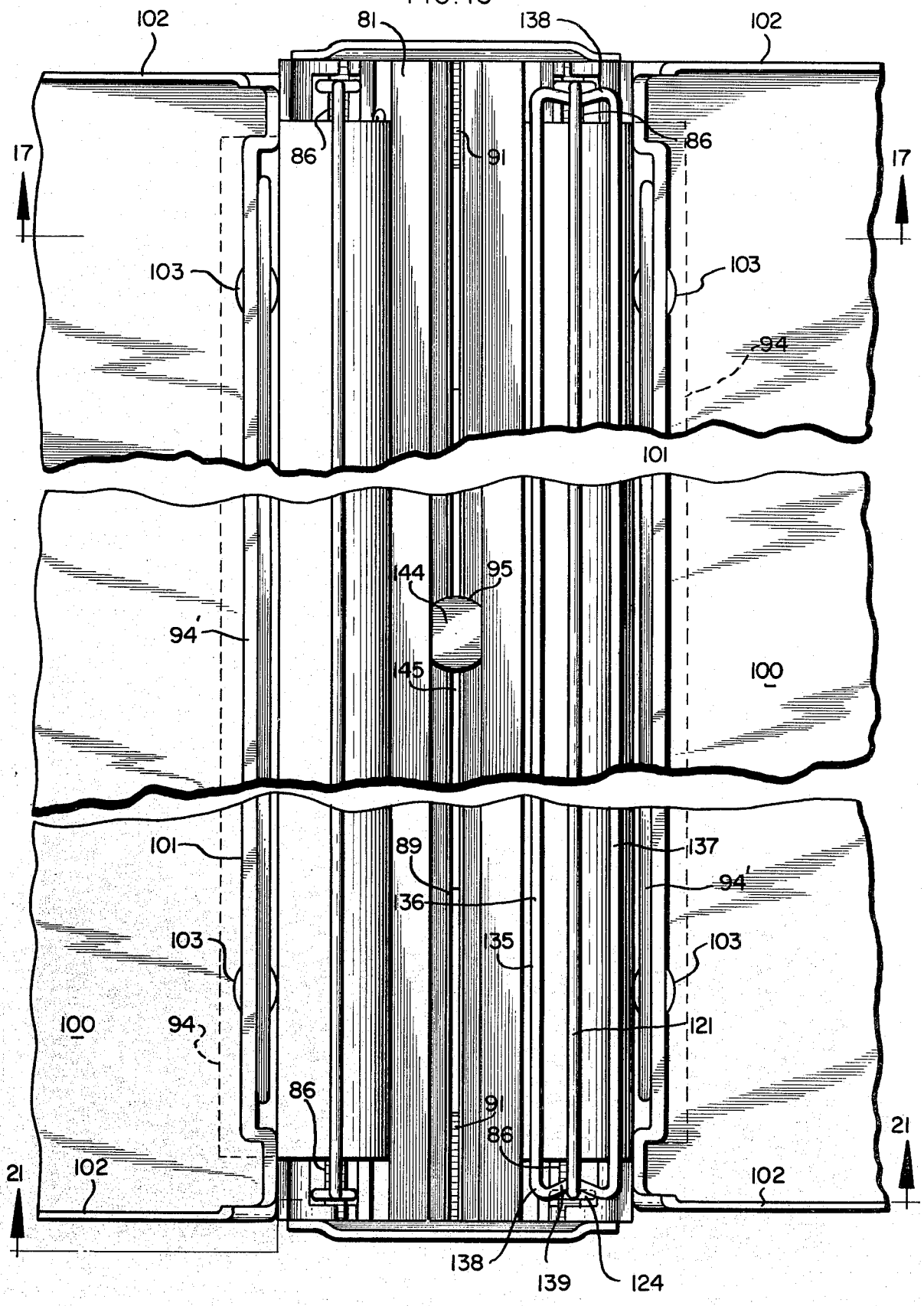
FIG. 16 shows a fragmentary view of the directory holder of the present invention in an open position without any directory being inserted in the holder.
Figure 17:
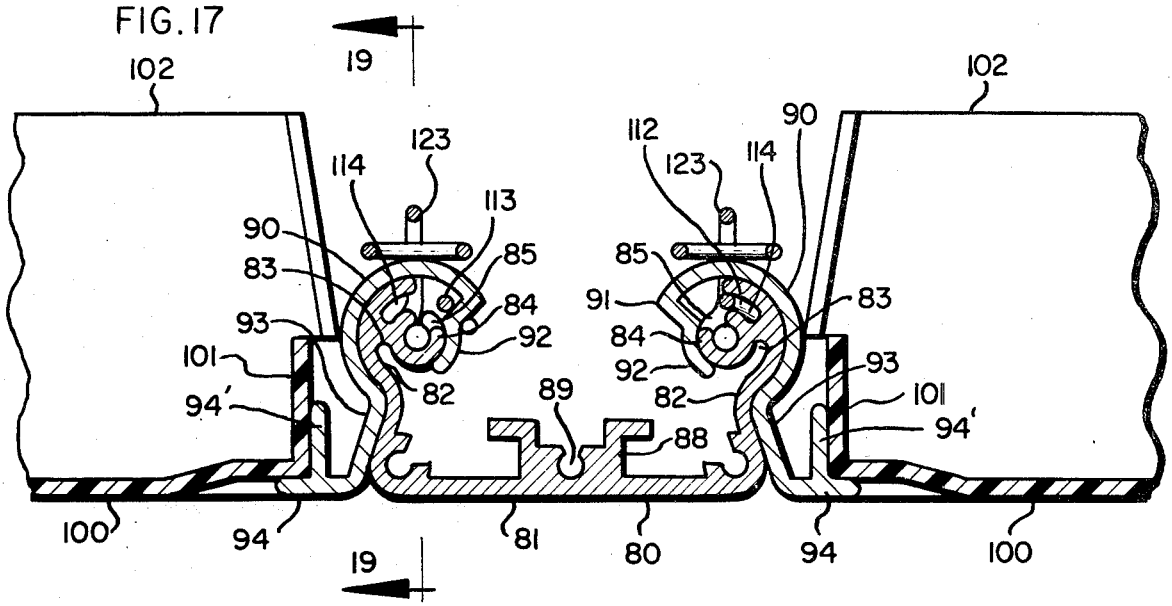
FIG. 17 shows a fragmentary, section view taken along lines 17—17 in FIG. 16 showing the directory securing loops seated within the bail on the holder hinge means.
Figure 18:
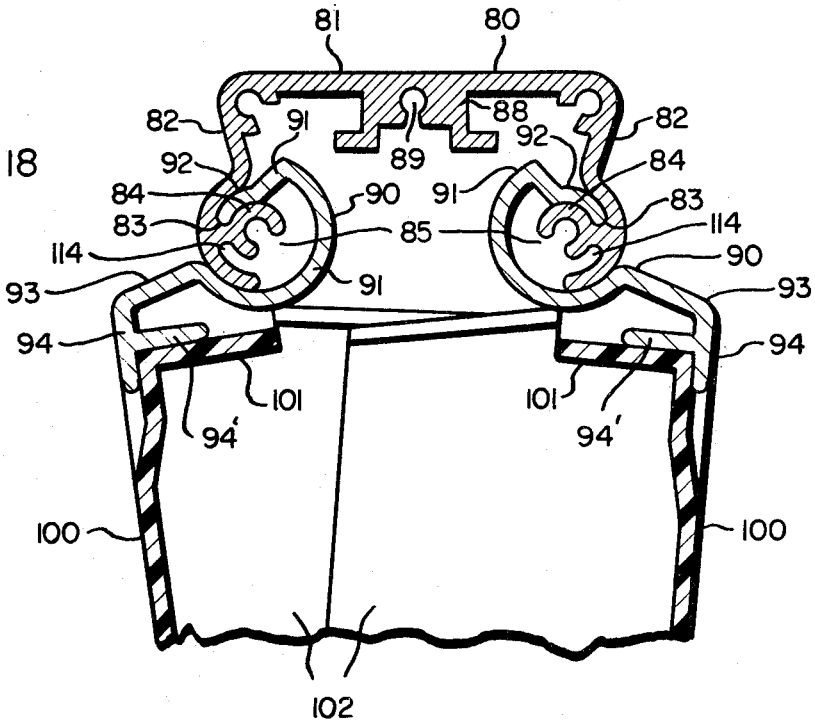
FIG. 18 is a fragmentary, section view of the directory holder of FIG. 17 in a closed position.
Figure 19:
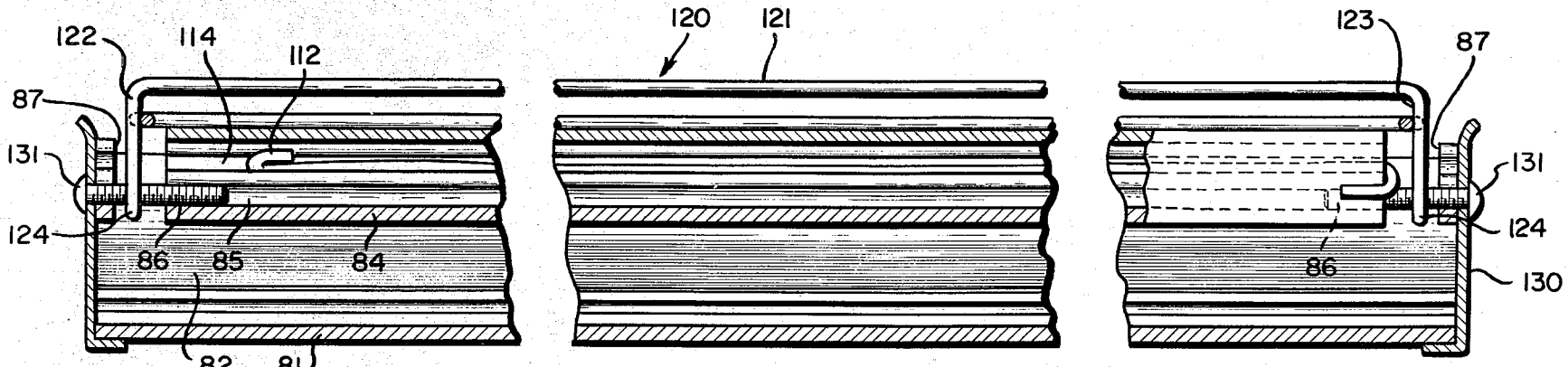
FIG. 19 is a plan section view taken along lines 19—19 in FIG. 17 showing a cover hinge attached to the directory backbone by means of a torsion bar member.

A flanged rib member 88, FIGS. 17–19, extends from the base 81. Rib 88 includes a slotted opening 89 which extends along the length of the rib and an opening 95, FIG. 16, for receiving a male swivel head. Each end of rib 88 is tapped at 91 as seen in FIG. 16.

An extruded metal cover hinge 90 which is complimentary with hinge post 82, is adapted to slip onto each hinge post 82. Each cover hinge comprises a hinge element 91, stop bar 92, stop strip 93 and a flanged cover connector 94. The covers 100 are stainless steel, pop riveted to flange 94'. Viewing FIGS. 17 and 18, when cover hinge 90 is inserted over hinge post 82, hinge 90 can rotate about post 82 in one direction until the outer edge of stop bar 92 abuts hinge stop 83, and in the opposite direction until stop strip 93 abuts hinge post 82.

Plastic cover leafs 100 include a back wall 101 and side walls 102 to protect a directory 15 when it is installed in holder 16. The back wall 101 is substantially smaller in height than the height of the cover side walls 102. Each cover leaf 100 is seated in a flanged cover connector 94 and held in place by means of rivets 103 or other suitable fastening means fastened thru backwall 101 and cover hinge flange 94'.

Stop strip 93 and flanged cover connector 94 are offset along their length to hinge element 91 as illustrated by the dotted lines in FIG. 16. This offset permits the cover leafs to be attached to cover connector 94 so that when a pair of directory covers 100 are closed, the cover side walls 102 will be positioned offset and adjacent to each other as seen, for example, in FIGS. 3 and 18. The offsetting of the stop strip and cover connector 94 also permit the cover side walls to be overlapped when the directory is in a closed position. Because the offset is provided, the two cover hinges 90 and cover leafs 100 can be identical which simplifies the manufacturing and reduces the costs for these component parts.

Figure 20:
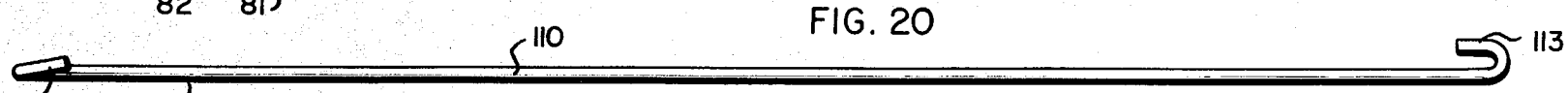
FIG. 20 shows a torsion bar member employed for attaching the cover hinges to the directory backbone; and, FIG. 21 shows a section view taken along lines 21—21 in FIG. 16 and further showing directories bound within the directory holder.

A torsion rod 110, shown in FIG. 20, is employed to provide a biased connection between cover hinge 90 and hinge post 82. Torsion bar 110 comprises a rod 111 having a hook 112 at one end and a hook 113 at the opposite end, The hooks are disposed 90° to each other. The length of rod 110 is less than the length of tubular portion 84.

Figure 21:
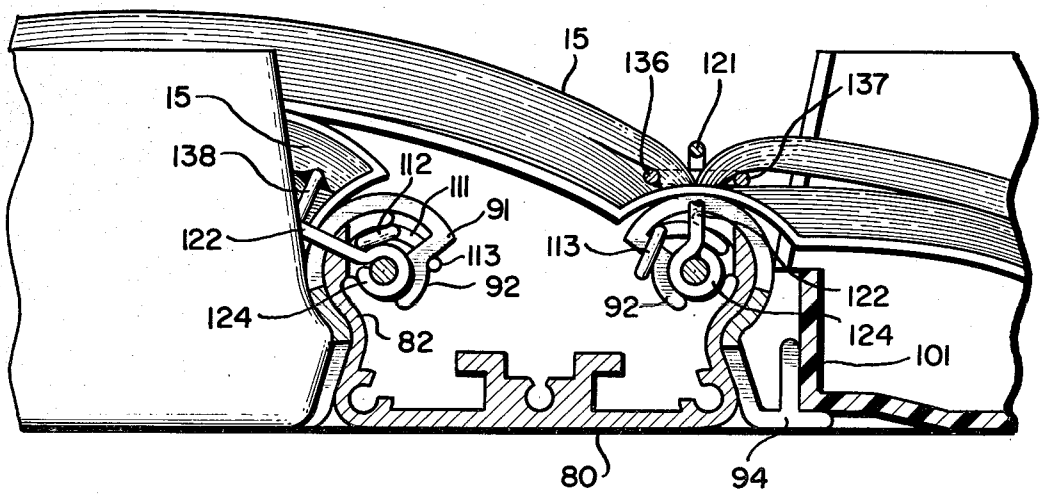

In assembly, torsion rod hook 112 is inserted into the slot 114 formed by hinge post 82, hinge stop 83 and tubular section 84. Canted hook 112 remains seated in slot 114. The canted end of the hook being spring loaded into the slot, cuts slightly into the metal member. Cover hinge 90 is then inserted over hinge post 82 and the torsion rod 110 and the remaining hook 113 are twisted over tubular section 84 and the remaining hook 113 is disposed over one end of hinge element 91 on cover hinge 90 as seen in FIGS. 19 and 21. The torsion rod serves as a spring means to bias the cover hinges 90 to hinge posts 82. The cover hinges are biased so that normally directory holder 16 is in a closed condition as illustrated in FIG. 18. However, when covers 100 are pulled apart, hinge 90 can be rotated until stop strip 93 abuts hinge post 82.

Figure 7:
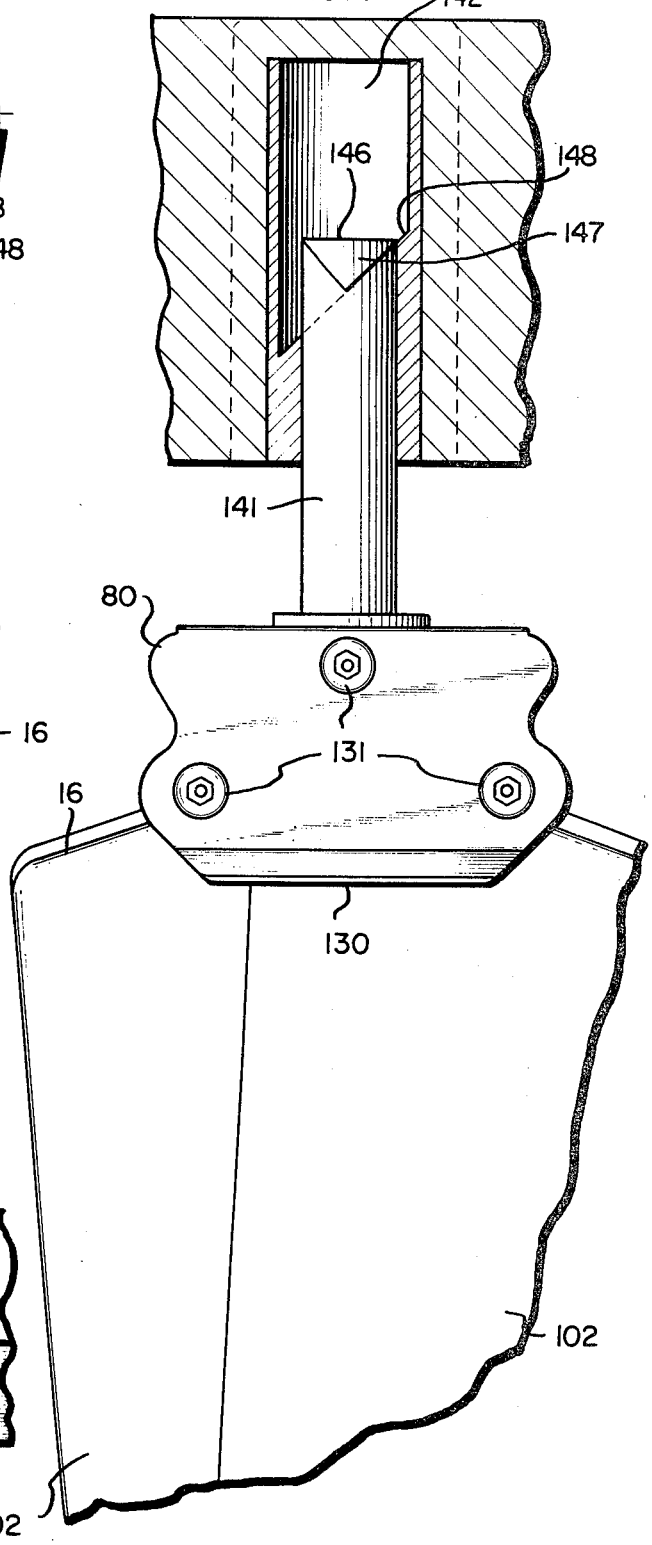
FIG. 7 shows a section view of the directory holder and swivel assembly of FIG. 6 with the directory holder rotated 90° and the male swivel rotated and raised vertically relative to the female swivel member.

Phonebooks 15 are held in directory 16 by means of a bail and security loop member. Bail 120, FIG. 10, comprises rod 121 with posts 122, 123 extending outward from the ends of rod 121. Each post is closed at its outboard end to form a loop 124. Posts 122 and 123 are disposed in the recesses 87. Backbone member end plates 130, FIGS. 7, 19, are then attached to each end of backbone member 80 and pinheaded security screws 131 are threaded through the end plates 130 and bail loops 124 into backbone member 80 as shown in FIGS. 7 and 19.

A security loop 135 is employed to lock a directory in directory holder 16. Loop 135, FIG. 16, comprises a pair of rods 136, 137 whose ends are joined by loop sections 138 which are indented at 139. The metal or plastic security loops 135 are inserted in phonebook 15, and then retained by bail 120 where bail posts 122, 123 are seated against section 138 at the location of the indents 139. As seen more clearly in FIG. 21, the loop 135 is maintained in position by the locking mechanism inherently provided by the combination of phonebook pages, bail 120 and the curvilinear hinge surface of hinge element 91 of cover hinge 90.

It will be observed from FIG. 21 that the bail rods 121 and security loop rods 136, 137 serve to retain two directories in holder 16. The utilization of the bail and security loop shown and disclosed herein permits easy access to an entire directory page by loosely holding and gently breaking the backbone of the phonebook over the curvilinear surface of the hinge element 91 of cover hinge 90. Large metropolitan phonebooks 15 can be inserted in an offset manner as shown in FIG. 21 so that when two phonebooks are employed in a directory holder 16, the books will sag together to allow the cover 90 to spring fully closed.

The bail 120, and the curvilinear surface of the hinge element 91 have the same geometric center when assembled into a directory holder.

The Directory Holder Mounting Assembly

Figure 6:
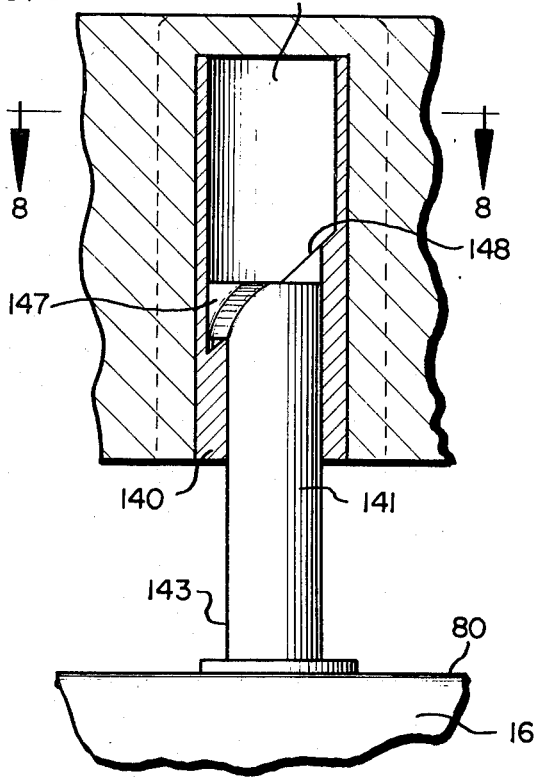
FIG. 6 shows a section view of a portion of the directory holder backbone and directory positioner swivel assembly for rotating the holder from a closed to an open position.

Directory holder 16 is mounted to yoke 60, FIG. 3, by means of a swivel assembly 140, FIG. 6, whereby holder 16 is permitted to swivel about yoke 60 in order that the directory remains in the closed position relative to enclosure 13 as shown in FIGS. 1 and 5 and opens to the 90° rotated position shown in FIG. 2. Swivel assembly 140, FIGS. 6 and 7, includes a male swivel 141 inserted in female swivel 142.

Male swivel 141 comprises an elongated member 143 having a directory mounting head 144 (FIG. 16) located at one end of member 143. Head 144 has an opening, not shown, through it so that when head 144 is inserted in opening 90 in backbone member 80, a locking rod 145, adapted to reside in the slotted rib opening 89 can be inserted through the male swivel head opening to lock the directory holder 16 to male swivel 141.

A cam 147 is located adjacent the remaining end 146 of male swivel 141. The cam is adapted to ride on a helical cam surface 148 formed in female swivel 142. It will be observed from viewing FIGS. 6 and 7 that when male swivel 141 with the directory holder 16 attached to one end, is rotated 90° from the position of the position in FIG. 6, the member 143 will enter female swivel 142 due to the travel of cam 147 along helical cam surface 148. Accordingly, as the directory holder moves from the open position of FIG. 2 to the closed position of FIG. 1, the directory will swivel 90°.

Figure 8:
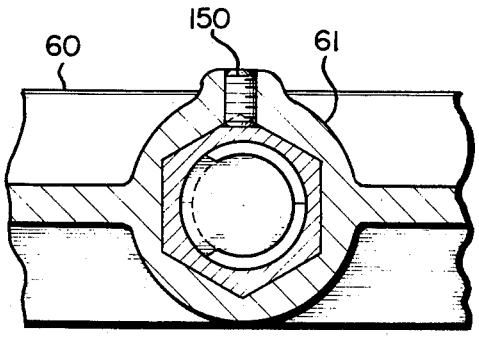
FIG. 8 shows a section view taken along lines 8—8 in FIG. 6 showing a top cross-section view of the male and female swivel members.

It will be observed from viewing FIGS. 6 and 8 that female swivel 142 is mounted within yoke mounting receptacle 61 and maintained in receptacle 61 by means of an Allen screw 150 or another suitable fastener which is threaded into the yoke until it abuts a groove in the outer wall of the female swivel thereby locking the swivel mounting assembly 140 in place on yoke 60.

The foregoing detailed description has been given for clearness of understanding only and no unnecessary limitations should be understood therefrom as modifications will be obvious to those skilled in the art.

What is claimed is:

1. A housing enclosure and directory holderassembly for use with a telephone unit, said assembly comprising:

a one-piece housing shell which at least partially encloses a telephone unit:

a directory holder assembly connected to said housing shell and including means for pivoting and swiveling said holder from a closed position to an open position;

said housing shell includes a pair of spaced side walls, a top wall and a back wall, said back wall having an opening with the edges of the opening being complimentary to the edges of a telephone unit adapted to be inserted in said opening, and an inclined wall surface located below said shell opening adapted to receive said telephone unit; and wedge means for securing said shell to a wall or pedestal mounting means, said wedge means including a tapered wall adapted to seat on said inclined shell wall and securing means for securing said wedge means to said telephone mounting means and wedging said wedge means below the telephone unit to lock said shell to each said wall or pedestal mounting means.

2. A housing shell for at least partially enclosing a telephone unit, said shell comprising a unitary member including a pair of side walls and a back wall having an opening through which a telephone unit is inserted:

said shell includes a pair of spaced side walls, a top wall and a back wall, said back wall having an opening with the edges of the opening being complimentary to the edge of a telephone unit adapted to be inserted in said opening, and an inclined wall surface located below said shell opening adapted to receive said telephone unit; and wedge means for securing said shell to a wall or pedestal mounting means, said wedge means including a tapered wall adapted to seat on said inclined shell wall and securing means for securing said wedge means to said telephone mounting means and wedging said wedge means below the telephone unit to lock said shell to each said wall or pedestal mounting means.

3. A directory holder mounting assembly for mounting a directory holder to a telephone enclosure, said mounting assembly including:

a yoke having arm extending from each end of the yoke;

a pair of first arms, each of said first arms having one of its two ends connected to a telephone enclosure and the remaining end connected to the outer end of one of said yoke arms;

a pair of second arms, each of said second arms having one of its two ends connected to a telephone enclosure and the remaining end connected to the outer end of said yoke arms; and mounting means for mounting a directory holder to said yoke, including means for swiveling said directory holder relative to said yoke, said mounting means includes a male swivel member having two ends, one of said ends being connected to said locking holder and the remaining end having a cam;

a tubular female swivel member having a helical cam surface on the inner diameter of said female swivel member; and said male member disposed within said female member.

4. A directory holder in accordance with claim 3 wherein said male swivel member being returned to a lowermost stored position in said female swivel member by gravity.

* * * * *

UNITED STATES PATENT AND TRADEMARK OFFICE

CERTIFICATE OF CORRECTION

PATENT NO. : 4,323,290

DATED : April 6, 1982

INVENTOR(S) : John S. Hickman et al

It is certified that error appears in the above-identified patent and that said Letters Patent are hereby corrected as shown below:

Col. 2, line 21, change "convered" to --covered--

Col. 4, line 37, change "42" to --46--;

Col. 7, line 34, change "64" to --65--.

Signed and Sealed this

*Twentieth* Day of *July 1982*

[SEAL]

*Attest:*

GERALD J. MOSSINGHOFF

*Attesting Officer*

*Commissioner of Patents and Trademarks*